US009228356B2

(12) United States Patent
Edwards et al.

(10) Patent No.: US 9,228,356 B2
(45) Date of Patent: Jan. 5, 2016

(54) ABOVE-DECK ROOF VENTING ARTICLE

(71) Applicant: 3M INNOVATIVE PROPERTIES COMPANY, St. Paul, MN (US)

(72) Inventors: John S. Edwards, Hudson, WI (US); Frank W. Klink, Oak Park Heights, MN (US); James N. Dobbs, Woodbury, MN (US); Jon A. Kirschhoffer, Stillwater, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 14/366,291

(22) PCT Filed: Dec. 17, 2012

(86) PCT No.: PCT/US2012/070034

§ 371 (c)(1),
(2) Date: Jun. 18, 2014

(87) PCT Pub. No.: WO2013/096171

PCT Pub. Date: Jun. 27, 2013

(65) Prior Publication Data

US 2014/0366470 A1 Dec. 18, 2014

Related U.S. Application Data

(60) Provisional application No. 61/579,297, filed on Dec. 22, 2011.

(51) Int. Cl.
*E04F 17/04* (2006.01)
*E04F 17/02* (2006.01)
(Continued)

(52) U.S. Cl.
CPC ..... *E04D 13/172* (2013.01); *E04B 1/947* (2013.01); *E04D 1/24* (2013.01); *E04D 1/28* (2013.01);
(Continued)

(58) Field of Classification Search
CPC ..... E04F 13/0869; E04F 17/04; E04F 17/02; E04B 1/64; E04B 1/66; E04B 1/70; E04B 1/7069; E04B 1/7076; E04B 1/947; E04D 13/17; E04D 13/0477; E04D 13/0445; E04D 13/172; E04D 1/24; E04D 1/28; E04D 1/30; E04D 13/002; E04D 2001/307; E04D 2001/309
USPC ..... 52/302.3, 302.1, 302.6, 408, 534, 52/716.2, 553
See application file for complete search history.

(56) References Cited

U.S. PATENT DOCUMENTS 592,474 A * 10/1897 Merrill ..... 52/533
633,019 A * 9/1899 Ludeling ..... 52/533
(Continued)

FOREIGN PATENT DOCUMENTS

DE 2240587 2/1974
DE 2250555 * 4/1974 ..... E04D 13/04
(Continued)

OTHER PUBLICATIONS

International Search Report for PCT International Application No. PCT/US2012/070034 mailed on Mar. 26, 2013, 4 pages.

*Primary Examiner* — Phi A
(74) *Attorney, Agent, or Firm* — Daniel J. Iden

(57) ABSTRACT

A roofing system and article for installation on a roof deck. The roofing article includes a body having an upper portion and an underside. A first channel is defined within the upper portion. The first channel includes an inlet. A second channel is defined intermediate the underside of the body and the roof deck. The second channel is operably connected to the first channel through an orifice, such that the outside air can enter the second channel through the orifice.

18 Claims, 6 Drawing Sheets

(51) Int. Cl.

| | |
|---|---|
| ***E04D 13/17*** | (2006.01) |
| ***E04D 1/24*** | (2006.01) |
| ***E04D 1/28*** | (2006.01) |
| ***E04B 1/94*** | (2006.01) |
| ***E04D 1/30*** | (2006.01) |
| ***E04D 13/00*** | (2006.01) |
| *F24F 7/02* | (2006.01) |

(52) U.S. Cl.

CPC ..... *E04D 1/30* (2013.01); *E04D 13/002* (2013.01); *E04D 13/17* (2013.01); *E04D 2001/307* (2013.01); *E04D 2001/309* (2013.01); *F24F 7/02* (2013.01)

(56) References Cited

U.S. PATENT DOCUMENTS

| | | | | | |
|---|---|---|---|---|---|
| 1,259,914 | A | | 3/1918 | Seward | |
| 1,266,137 | A | * | 5/1918 | Melds | 52/533 |
| 2,318,820 | A | | 5/1943 | Voigt | |
| 2,370,638 | A | * | 3/1945 | Crowe | 52/408 |
| 2,477,152 | A | | 7/1949 | Stevenson | |
| 3,006,113 | A | | 10/1961 | Barnes | |
| 3,058,265 | A | | 10/1962 | Lapsensohn | |
| 3,660,955 | A | | 5/1972 | Simon | |
| 3,683,785 | A | | 8/1972 | Grange | |
| 3,686,813 | A | | 8/1972 | Breitwieser | |
| 3,797,180 | A | | 3/1974 | Grange | |
| 4,125,971 | A | | 11/1978 | Ward | |
| 4,189,878 | A | | 2/1980 | Fitzgerald | |
| 4,237,672 | A | | 12/1980 | Peterson | |
| 4,254,598 | A | | 3/1981 | Rugroden | |
| 4,406,095 | A | | 9/1983 | Slavik | |
| 4,446,661 | A | | 5/1984 | Jonsson | |
| 4,534,142 | A | * | 8/1985 | Drefahl | 52/90.2 |
| 4,635,419 | A | | 1/1987 | Forrest | |
| 4,642,518 | A | | 2/1987 | Dard | |
| 4,651,491 | A | * | 3/1987 | Cooper | 52/534 |
| 4,660,463 | A | | 4/1987 | Bottomore | |
| 4,677,903 | A | | 7/1987 | Mathews, III | |
| 4,781,243 | A | | 11/1988 | De Vogel | |
| 4,852,314 | A | | 8/1989 | Moore, Jr. | |
| 4,977,714 | A | | 12/1990 | Gregory, Jr. | |
| 5,060,444 | A | * | 10/1991 | Paquette | 52/535 |
| 5,144,782 | A | * | 9/1992 | Paquette et al. | 52/408 |
| 5,295,339 | A | | 3/1994 | Manner | |
| 5,377,468 | A | * | 1/1995 | Repasky | 52/302.4 |
| 5,524,381 | A | | 6/1996 | Chahroudi | |
| 5,549,513 | A | | 8/1996 | Thomas | |
| 5,596,847 | A | | 1/1997 | Stephenson | |
| 5,600,928 | A | | 2/1997 | Hess | |
| 5,630,752 | A | | 5/1997 | Gubash | |
| 5,673,521 | A | | 10/1997 | Coulton | |
| 5,766,071 | A | | 6/1998 | Kirkwood | |
| 6,049,419 | A | | 4/2000 | Wheatley | |
| 6,061,978 | A | | 5/2000 | Dinwoodie | |
| 6,092,344 | A | | 7/2000 | Kelly | |
| 6,346,040 | B1 | | 2/2002 | Best | |
| 6,357,193 | B1 | | 3/2002 | Morris | |
| 6,487,826 | B1 | | 12/2002 | McCorsley | |
| 6,780,099 | B1 | | 8/2004 | Harper | |
| 6,797,396 | B1 | | 9/2004 | Liu | |
| 6,927,900 | B2 | | 8/2005 | Liu | |
| 6,955,012 | B2 | | 10/2005 | Suzuki | |
| 7,077,124 | B2 | | 7/2006 | Szymocha | |
| 7,169,459 | B2 | | 1/2007 | Lichodziejewski | |
| 7,231,744 | B2 | | 6/2007 | Cooper | |
| 7,240,804 | B2 | | 7/2007 | King | |
| 7,302,776 | B2 | | 12/2007 | Duncan | |
| 7,389,699 | B2 | | 6/2008 | Kelly | |
| 7,455,899 | B2 | | 11/2008 | Gross | |
| 7,458,189 | B2 | | 12/2008 | Pollack | |
| 7,565,775 | B2 | | 7/2009 | Cooper | |
| 7,648,755 | B2 | | 1/2010 | Gross | |
| 7,654,051 | B2 | | 2/2010 | Pollack | |
| 7,758,408 | B2 | | 7/2010 | Hagentoft | |
| 7,765,754 | B2 | * | 8/2010 | Johnson et al. | 52/302.3 |
| 7,805,905 | B2 | | 10/2010 | Rodrigues | |
| 7,919,170 | B2 | | 4/2011 | Gross | |
| 7,922,950 | B2 | | 4/2011 | Anderson | |
| 8,065,841 | B2 | | 11/2011 | Antonic | |
| 2001/0009714 | A1 | | 7/2001 | Wheatley | |
| 2003/0126806 | A1 | | 7/2003 | Ellis | |
| 2005/0243425 | A1 | | 11/2005 | Wheatley | |
| 2005/0246973 | A1 | | 11/2005 | Jensen | |
| 2006/0121845 | A1 | | 6/2006 | Sells | |
| 2006/0218869 | A1 | | 10/2006 | Ellis | |
| 2007/0051069 | A1 | | 3/2007 | Grimes | |
| 2007/0072541 | A1 | | 3/2007 | Daniels, II | |
| 2007/0207725 | A1 | * | 9/2007 | O'Hagin | 454/365 |
| 2007/0243820 | A1 | | 10/2007 | O'Hagin | |
| 2008/0098674 | A1 | | 5/2008 | Daniels | |
| 2008/0113612 | A1 | | 5/2008 | Chich | |
| 2008/0152867 | A1 | | 6/2008 | Di Pede | |
| 2008/0236058 | A1 | | 10/2008 | Antonie | |
| 2009/0203308 | A1 | | 8/2009 | O'Hagin | |
| 2010/0229498 | A1 | | 9/2010 | Pollack | |
| 2010/0330898 | A1 | | 12/2010 | Daniels | |
| 2011/0030287 | A1 | | 2/2011 | Moore | |
| 2011/0265407 | A1 | | 11/2011 | Bryson | |
| 2012/0047844 | A1 | | 3/2012 | Walker | |
| 2012/0085053 | A1 | * | 4/2012 | Barone | 52/302.1 |
| 2012/0090266 | A1 | | 4/2012 | McCary | |
| 2012/0266553 | A1 | | 10/2012 | Shiao | |
| 2013/0217318 | A1 | * | 8/2013 | Edwards et al. | 454/366 |
| 2014/0115980 | A1 | | 5/2014 | Edwards | |

FOREIGN PATENT DOCUMENTS

| | | | | |
|---|---|---|---|---|
| DE | 3002152 | | 7/1981 | |
| DE | 9309676 | | 11/1993 | |
| EP | 0172310 | * | 11/1985 | E04D 13/17 |
| EP | 0663487 | | 7/1995 | |
| EP | 2019172 | | 1/2009 | |
| GB | 2262295 | | 6/1993 | |
| GB | 2345536 | | 7/2000 | |
| JP | 63-25719 | | 2/1988 | |
| WO | 98-31894 | | 7/1998 | |
| WO | 00-66854 | | 11/2000 | |
| WO | 2004-004837 | | 1/2004 | |
| WO | 2006-063333 | | 6/2006 | |
| WO | 2012-033816 | | 3/2012 | |
| WO | 2012-170483 | | 12/2012 | |
| WO | 2014-070450 | | 5/2014 | |

* cited by examiner

ABOVE-DECK ROOF VENTING ARTICLE

FIELD

The present disclosure generally relates to roofing materials. More particularly, the present disclosure relates to a roofing system having an airflow path therein.

BACKGROUND

It can be desirable to use construction articles that provide energy conservation advantages for buildings and housing structures. Absorbed solar energy increases cooling energy costs in buildings, particularly in warm southern climates, which can receive a high incidence of solar radiation. An absorber of solar energy is building roofs. It is not uncommon for the air temperature within an attic or unconditioned space that is adjacent to or under a roof, to exceed the ambient air temperature by 40° F. (about 22.2° C.) or more, due in part to absorption of solar energy by the roof or conduction of the solar energy through the roof. This can lead to significant energy costs for cooling the interior spaces of a building to a comfortable living temperature.

SUMMARY

The subject matter of the present disclosure, in its various combinations, either in apparatus or method form, may be characterized by the following non-exhaustive list of exemplary embodiments:

1. A roofing article for installation on a roof deck, said roofing article comprising:

a body comprising an upper portion and an underside;

a first channel defined within said upper portion, said first channel comprising an inlet through which outside air can enter said first channel; and a second channel defined intermediate said underside of said body and the roof deck, wherein said second channel is operably connected to said first channel through an orifice such that the outside air can enter said second channel through said orifice.

2. The roofing article of embodiment 1, wherein said second channel is in airflow communication with an unconditioned space and wherein unconditioned air from the unconditioned space can enter said second channel.
3. The roofing article of embodiment 2, wherein the unconditioned air entering said second channel can mix with outside air entering said second channel through said orifice to form mixed air.
4. The roofing article of any of embodiments 2 or 3, wherein the unconditioned space is an attic.
5. The roofing article of any of embodiments 1-4, further comprising insulation presented intermediate said first channel and said second channel.
6. The roofing article of any of the preceding embodiments, wherein said first channel comprises an first channel upper internal surface and a first channel lower internal surface, wherein one or more of said first channel upper internal surface and said first channel lower internal surface comprises a radiant barrier presented therewith.
7. The roofing article of any of the preceding embodiments, wherein said second channel comprises an second channel upper internal surface and a second channel lower internal surface, wherein one or more of said second channel upper internal surface and said second channel lower internal surface comprises a radiant barrier presented therewith.

8. The roofing article of any of the preceding embodiments, further comprising an air director presented in said first channel proximate said orifice to direct outside air into orifice.
9. The roofing article of any of the preceding embodiments, further comprising an airflow interrupter for at least partially closing at least one of said first channel or said second channel when said airflow interrupter is exposed to temperatures at or greater than about 350 degrees Fahrenheit.
10. The roofing article of embodiment 9, wherein said airflow interrupter comprises an intumescent material.
11. The roofing article of any of the preceding embodiments, further comprising a cover presented with said inlet, said cover enabling outside air to flow therethrough into said first channel.
12. The roofing article of embodiment 11, wherein said cover inhibits mold or algae growth.
13. The roofing article of any of embodiments 11 or 12, wherein said cover comprises at least one of copper-containing materials, zinc-containing material, or photocatalytic material.
14. The roofing article of any of embodiments 11-13, wherein said cover is meltable so as to at least partially close said inlet in the event of a fire.
15. The roofing article of any of embodiments 11-14, wherein said cover comprises polyester.
16. The roofing article of any of the preceding embodiments, wherein a ratio of a cross section of said inlet to a cross section of said orifice is between about 2 to about 48.
17. The roofing article of any of the preceding embodiments, wherein a ratio of a cross section of said inlet to a cross section of said orifice is between about 1 to about 12.
18. The roofing article of any of the preceding embodiments, wherein said roofing article is operably coupled to one or more rails presented on a roof deck.
19. A roofing system comprising at least two roofing articles, each roofing article comprising:

a body comprising an upper portion and an underside;

a first channel defined in said body, said first channel comprising an inlet through which outside air can enter said first channel; and a second channel defined intermediate said underside of said body and the roof deck, wherein said second channel is operably connected to said first channel through an orifice such that the outside air can enter said second channel through said orifice, wherein the second channels of each of the at least two roofing articles are in airflow communication so as to create an airflow path between the at least two roofing articles.

20. The roofing system of embodiment 19, wherein the second channel of each of the at least two roofing articles is in airflow communication with an unconditioned space and wherein unconditioned air from the unconditioned space can enter said second channel.
21. The roofing system of any of embodiments 19-20, wherein the unconditioned air entering said second channel of each of the at least two roofing articles can mix with outside air entering said second channel of the at least two roofing articles through said orifice to form mixed air, wherein said mixed air can exit said second channel of the at least two roofing articles.
22. The roofing article of any of embodiments 19-21, further comprising an airflow interrupter presented with said airflow path for at least partially closing at least one of said first channel or said second channel when said airflow interrupter is exposed to temperatures at or greater than about 350 degrees Fahrenheit.

23. The roofing article of embodiment 22, wherein said airflow interrupter comprises an intumescent material.

24. A roofing system for installation on a roof deck comprising:

at least two roofing articles, each roofing article comprising:

a body comprising an upper portion and an underside;

a first channel defined in said body, said first channel comprising an inlet through which outside air can enter said first channel; and a second channel defined intermediate said underside of said body and the roof deck, wherein said second channel is operably connected to said first channel through an orifice such that the outside air can enter said second channel through said orifice; and at least one rail presented on roof deck, wherein said at least two roofing articles are configured to be operably serially coupled to rail, such that said second channel of said at least two roofing articles is substantially aligned to create an airflow path.

25. The roofing system of embodiment 24, wherein said rail is integrally formed with a rail sheet that can be operably coupled to the roof deck.

26. The roofing system of any of embodiments 24 or 25, wherein the rail sheet comprises a plurality of rails.

27. The roofing system of any of embodiments 24-26, wherein the roofing article comprises a plurality of first channels.

28. The roofing system of any of embodiments 24-27, wherein the roofing article comprises a plurality of second channels.

BRIEF DESCRIPTION OF THE DRAWINGS

The disclosed subject matter will be further explained with reference to the attached figures, wherein like structure is referred to by like reference numerals throughout the several views.

While the above-identified figures set forth several embodiments of the disclosed subject matter, other embodiments are also contemplated, such as those noted in the disclosure. In all cases, this disclosure presents the disclosed subject matter by way of representation and not by limitation. The figures are schematic representations, for which reason the configuration of the different structures, as well as their relative dimensions, serves illustrative purposes only. Numerous other modifications and embodiments can be devised by those skilled in the art, which other modifications and embodiments fall within the scope and spirit of the principles of this disclosure.

DETAILED DESCRIPTION

When in the following terms such as "upper" and "lower", "top" and "bottom", "right" and "left", or similar relative expressions are used, these terms only refer to the appended figures and not necessarily to an actual situation of use.

The present disclosure broadly relates to a roofing article with an airflow path for use in an above-deck roof ventilation system, and methods of installing such roofing articles. Various exemplary embodiments of the disclosure will now be described with particular reference to the Drawings. Embodiments of the present disclosure may take on various modifications and alterations without departing from the spirit and scope of the disclosure. Accordingly, it is to be understood that the embodiments of the present disclosure are not to be limited to the following described exemplary embodiments, but is to be controlled by the limitations set forth in the claims and any equivalents thereof.

Thus, reference throughout this specification to "one embodiment," "embodiments," "one or more embodiments" or "an embodiment," whether or not including the term "exemplary" preceding the term "embodiment," means that a particular feature, structure, material, or characteristic described in connection with the embodiment is included in at least one embodiment of the exemplary embodiments of the present disclosure. Therefore, the appearances of the phrases such as "in one or more embodiments," "in embodiments," "in one embodiment" or "in an embodiment" in various places throughout this specification are not necessarily referring to the same embodiment of the exemplary embodiments of the present disclosure. Furthermore, the particular features, structures, materials, or characteristics may be combined in any suitable manner in one or more embodiments.

Figure 1:
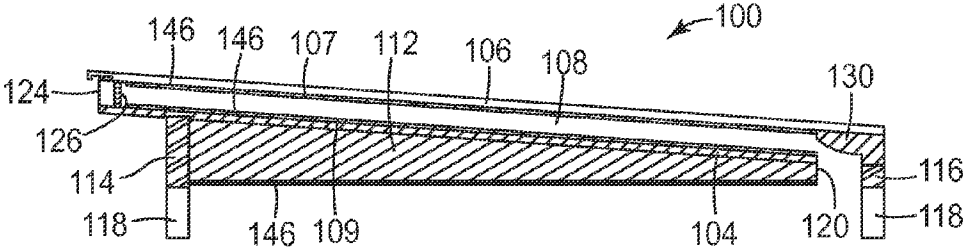
FIG. 1 is a cross-sectional schematic side view of a roofing article according to a first embodiment.
Figure 2:
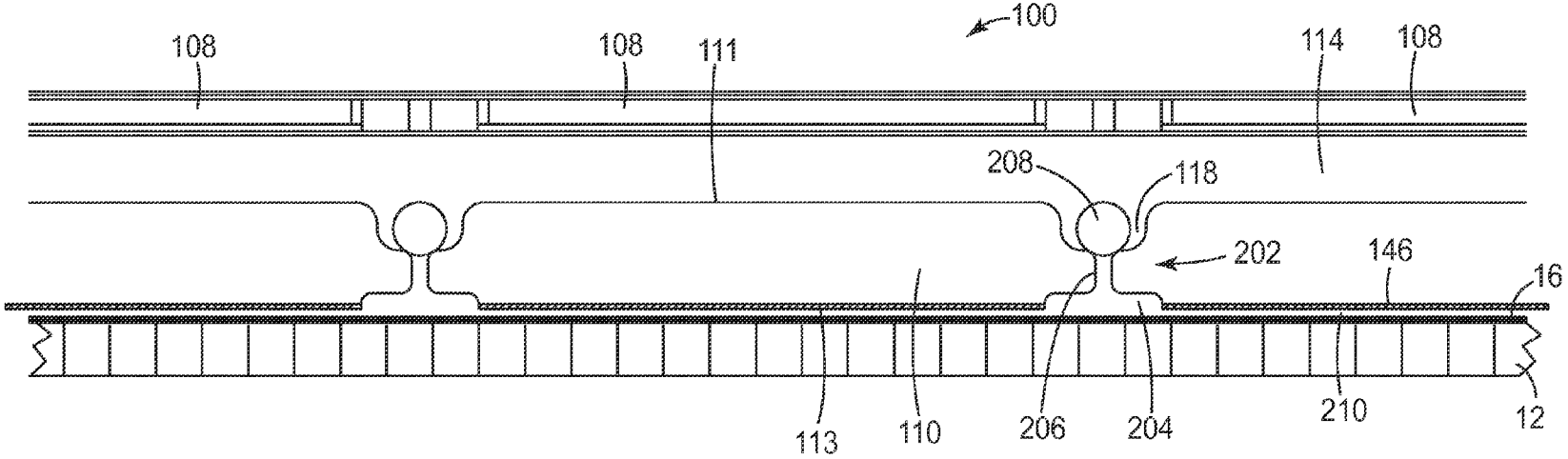
FIG. 2 is a second cross-sectional schematic side view of a roofing system including the roofing article of FIG. 1.

Referring to FIG. 1, a roofing article 100 according to a first embodiment of the present disclosure can include a body having a bottom sheet 104 and a top sheet 106 overlaying at least a portion of bottom sheet 104, and one or more first air channels 108 defined or presented in an upper portion of said body intermediate top sheet 106 and bottom sheet 104. First air channel 108 includes a first channel upper internal surface 107 and a first channel lower internal surface 109. Referring to FIG. 2, as described in detail below, one or more second air channels 110 are defined or presented below bottom sheet 104 and intermediate a roof deck 12. Referring to FIG. 2, second channel 110 includes a second channel upper internal surface 111 and a second channel lower internal surface 113. First channel 108 and second channel 110 can be interconnected or otherwise in fluid or airflow communication by an aperture 120 or orifice, which is described in further detail below.

Depending on the climate, the roofing articles can be designed so as to ensure or optimize that mixed air stays in the second channel path. This can be done by minimizing the size of the aperture between the first and second channels—so as to increase the resistance through the aperture relative to the resistance of the second channel pathway. Some climates where it can be desirable to ensure or optimize that mixed air stays in the second channel path include colder climates. By retaining the mixed, warmer air in the second channel path, it can help to heat the entire roof and, as a result, melt the snow on the entire roof.

Also, the roofing articles can be designed so as to allow for air to back out of an air inlet included on one of the roofing articles. This can be done by maximizing the size of one or more apertures between the first and second channels—so as to decrease the resistance through the aperture relative to the resistance of the second channel pathway. Some climates where it can be desirable to release air from the second channel path include warmer climates. By enabling air to be released, it can help to keep the roof cooler.

In embodiments wherein it is desired to maintain air flow along an entire length (from bottom to top) of a roof, i.e., so that any air exiting the roofing articles is inhibited, the cross-sectional area of the aperture 120 can be between about 0.05 square inches and about 0.70 square inches (wherein a ratio of the air inlet 124 cross-sectional area to the cross-sectional area of the aperture 120 is about 2.0 to about 48.0). Preferably, the cross-sectional area can be between about 0.15 square inches and about 0.35 square inches (wherein a ratio of the cross-sectional area of the air inlet 124 to the cross-sectional area of the aperture 120 is about 5.0 to about 16.0). Optimally, the cross-sectional area can be between about 0.15 square inches and about 0.25 square inches (wherein a ratio of the cross-sectional area of the air inlet 124 to the cross-sectional area of the aperture 120 is about 8.0 to about 16.0). Such embodiments can be used, for example, in cooler or cold climate zones 4-7.

In embodiments wherein it is desired to vent air flow along one or more points along a length (from bottom to top) of a roof, the cross-sectional area can be between about 0.20 square inches and about 1.25 square inches (wherein a ratio of the air inlet 124 cross-sectional area to the cross-sectional area of the aperture 120 is about 1.0 to about 12.0). Preferably, the cross-sectional area can be between about 0.30 square inches and about 0.80 square inches (wherein a ratio of the cross-sectional area of the air inlet 124 to the cross-sectional area of the aperture 120 is about 2.0 to about 8.0). Optimally, the cross-sectional area can be between about 0.45 square inches and about 0.70 square inches. Such air flow is described in greater detail below (wherein a ratio of the cross-sectional area of the air inlet 124 to the cross-sectional area of the aperture 120 is about 2.0 to about 5.5). Such embodiments can be used, for example, in warm or hot climate zones 1-4.

In embodiments, aperture 120 can be circular in shape, although other shapes can be used without departing from the spirit and scope of the present disclosure. Bottom sheet 104 and top sheet 106 can be formed of various high temperature and fire retardant materials, such as thermoplastic polymers, such as thermoplastic polyolefin, or fluoro or chloro polymers, such as polyvinylidene fluoride, fluorinated ethylene propylene, polytetrafluoroethylene, and polyvinyl chloride using various forming methods, such as, for example, injection molding or thermoforming, although other materials, such as polycarbonate, acrylonitrile butadiene styrene, steel (for example, galvanized), concrete, clay, and treated wood-based products, can be used to form each these components. Other forming methods can include, for example, metal stamping, press forming, pan forming, and various component and piece assembly methods. Additionally, bottom sheet 104 and top sheet 106 can be integrally formed or formed separately and then attached, affixed, or otherwise coupled together. Top sheet 106 can include a layer or layers of roofing granules presented thereon, such as, for example, those described in U.S. Pat. Nos. 7,455,899, 7,648,755, and 7,919,170, each of which is incorporated by reference herein in its entirety. Top sheet 106 and/or layer or layers of roofing granules presented thereon can be replaceable, such that this portion can be replaced without the other portions of roofing article 100.

Portions of body, including bottom sheet 104 and/or top sheet 106 can be formed using a dark material, such as black, or otherwise coated so as to give a dark appearance. Color, in general, can be defined by "Lab color space or component color" or CIE 1976 (L*, a*, b*), where L* is 0 for black and 100 for white (a is + positive for red and – negative for green, b is + positive for yellow and – negative for blue). This method is a three dimensional way of defining coloring. In general, a "dark" color can be from 0 to about 30 on the L* scale.

Referring to FIG. 1, a thermal insulation layer 112 can optionally (depending, for example, on climate zone) be included on roofing article, such as on or adjacent to, or incorporated with or adhered to, an underside of bottom sheet 104. Insulation layer 112 can be formed of extruded polystyrene foam (XPS), although other materials, such as expanded polystyrene foam (EPS), polyisocyanurate, polyurethane, or other type of insulation material that has a R value in the range of 2-8 per inch of thickness, can be used.

Referring to FIGS. 1 and 2, roofing article 100 includes a first post member 114 and a second post member 116, each including one or more rail bushings or rail huggers 118. Referring to FIG. 2, bushings are shaped so as to mate with a rail having rail head with a circular cross section, although those skilled in the art will understand that other shapes can be used without departing from the spirit and scope of the present disclosure.

In embodiments, rail huggers 118 can be omitted from first post member 114 or second post member 116, wherein an edge of roofing article 100 is operably coupled to an adjacent roofing article 100 by, for example, a tab and slot attachment mechanism or other attachment mechanism. This can facilitate ease of design and/or assembly and reduce the number of rail huggers 118 used.

Referring to FIG. 1, first channel 108 can comprise an air inlet 124 at a first end thereof. Air inlet 124 can include a cover 126, such as a perforated rigid material with a fire protective type covering, a screen, scrim, nonwoven web, or other structure to inhibit the ingress of snow, insects, birds, small animals, debris, precipitation (e.g., rain, snow, sleet, hail) from entering air inlet 124. Cover is preferably UV stable. In embodiments, cover 126 can be formed with a meltable material, such as a polyester fabric, so as to close the air inlet, and, therefore, any airway path or funnel, such as in the event of a fire. In embodiments, cover 126, such as a screen, can include, for example, a copper-containing material (such as, for example, cuprous oxide) or a zinc-containing material, such as in the form of a strip, particles, or other form in the screen, such that copper or zinc ions released from the strip can inhibit the growth of algae and other fungus material in cover. In other embodiments, cover 126 can include photocatalytic particles, such as, for example, $TiO_2$, ZnO, $WO_3$, $SnO_2$, $CaTiO_3$, $Fe_2O_3$, $MoO_3$, $Nb_2O_5$, $TiXZr(1-x)O_2$, SiC, $SrTiO_3$, CdS, GaP, InP, GaAs, $BaTiO_3$, $KNbO_3$, $Ta_2O_5$, $Bi_2O_3$, NiO, $Cu_2O$, $SiO_2$, $MoS_2$, InPb, $RuO_2$, $CeO_2$, $Ti(OH)_4$, combinations thereof, or inactive particles coated with a photocatalytic coating. U.S. Pat. No. 7,922,950, issued Apr. 12, 2011, entitled, "Monolithic building element with photocatalytic material," is incorporated by reference herein in its entirety for its teaching of, for example, photocatalytic materials, particles, and coatings and uses for such photocatalytic materials, particles, and coatings.

Figure 5:
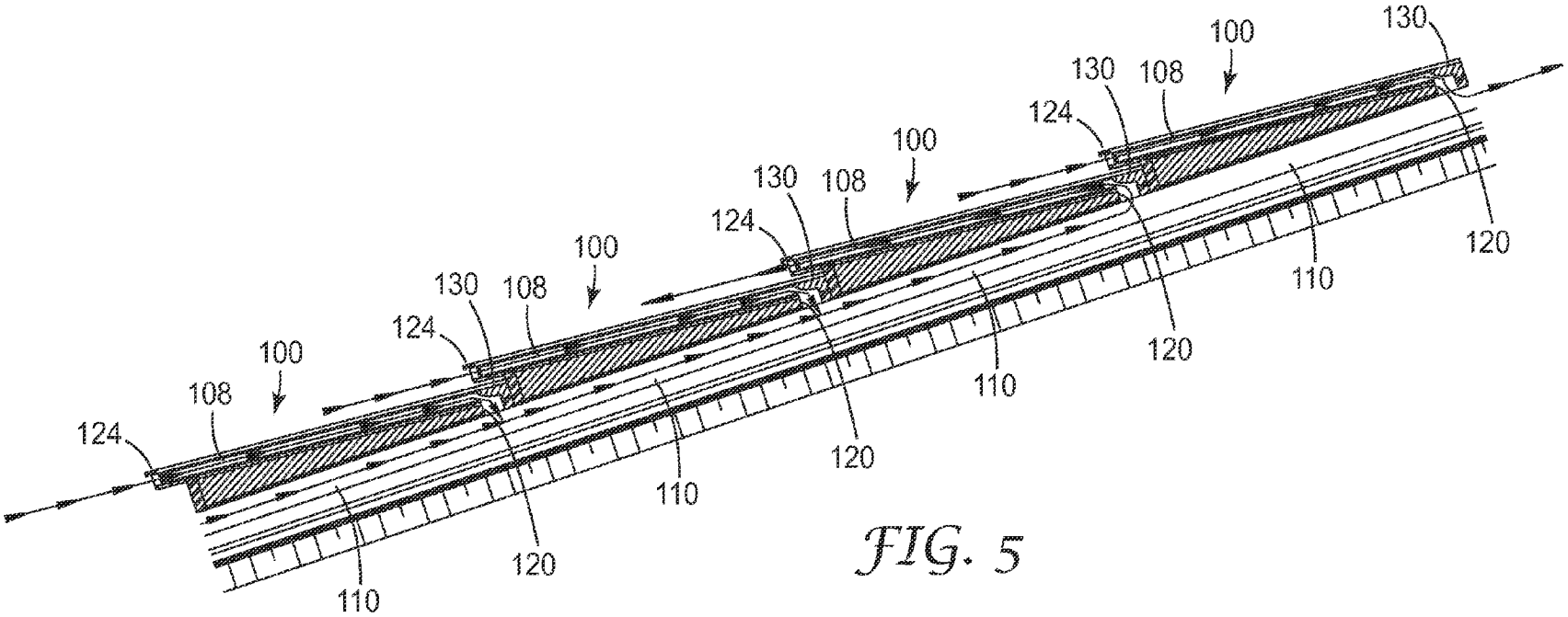
FIG. 5 is the fragmentary cross-sectional schematic side view of FIG. 3 depicting air flow.

Cover 126 can be integrally formed with top sheet 106 and bottom sheet 104 or formed separately and then attached, connected, or otherwise coupled to top sheet 106 and/or bottom sheet 104. The first end of first channel 108, including air inlet 124 and cover 126, can comprise a color chosen for aesthetic purposes. As discussed herein, darker colors are oftentimes preferred. This can be accomplished by using a relatively dark color for first end of first channel 108, including air inlet 124 and cover 126, so as to give a roof a darker appearance when viewed by someone standing below the roof deck surface. As can be seen in FIG. 5, when assembled, there are two general exposed surfaces—the top surface of top sheet 106 and the first end of first channel 108, including air inlet 124 and cover 126. When the roof is viewed by someone standing below the roof deck surface, that person largely sees the first end of first channel 108.

Figure 6:
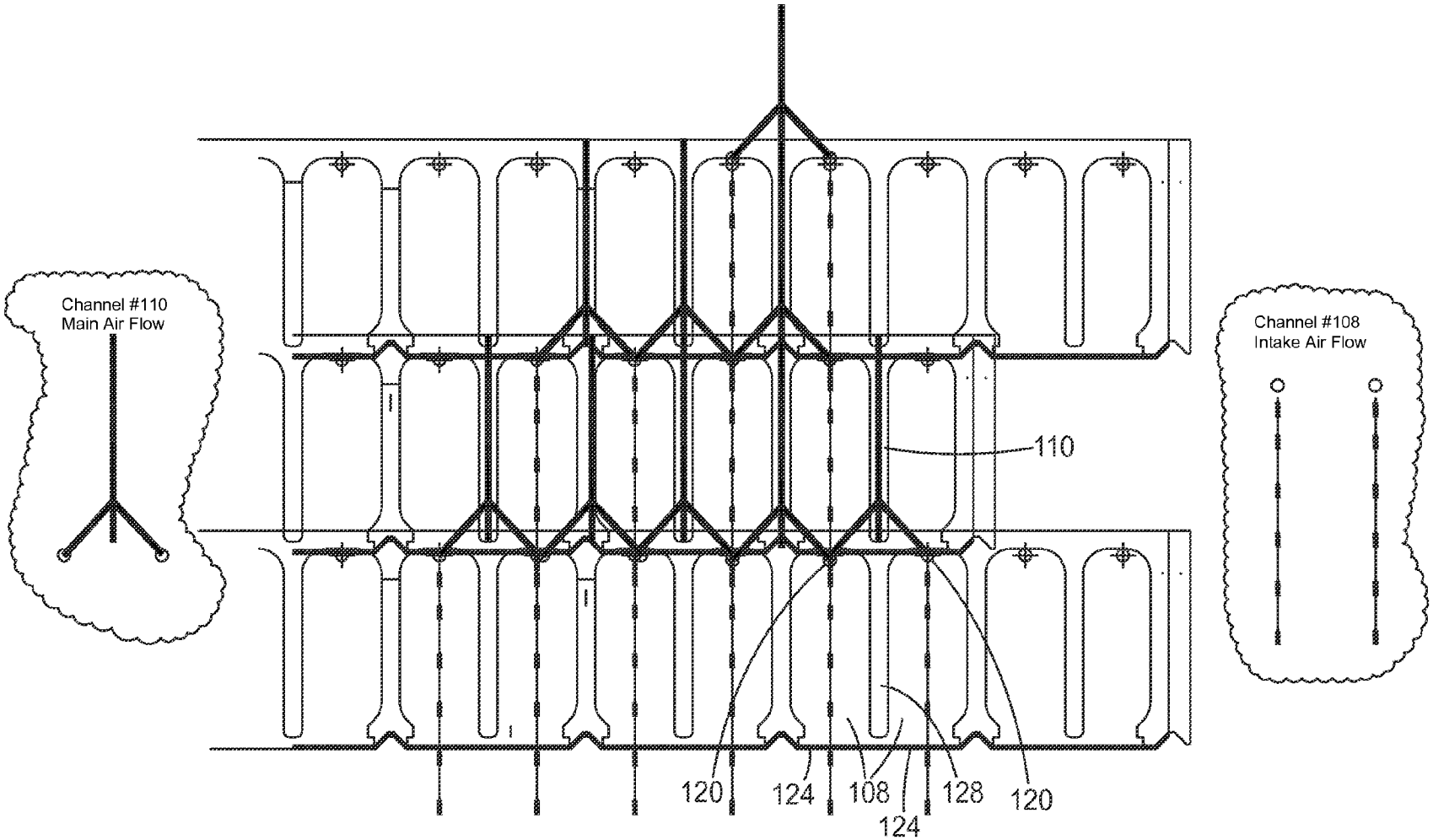
FIG. 6 is a cutaway schematic top view of the roofing article of FIG. 1 in panel form.

Referring to FIG. 6, first channel 108 can further include one or more ribs 128 or air guides (one depicted) that can direct free and force convection. The ribs 128 can extend between top sheet 106 and bottom sheet 104 to provide further structural integrity to roofing article 100. Referring again to FIG. 1, first channel 108 can also include an air director 130 positioned proximate aperture 120 that can guide or route incoming outside intake airflow down through aperture into second air channel. Air director 130 can be formed of various materials, such as, for example, the materials and formation methods described above with respect to bottom sheet 104 and top sheet 106, although other materials, such as a plastic-coated intumescent material for fire protection, ceramics, and other non corrosive materials, can be used. Also, air director 130 can be integrally formed within first channel 108, such as with top sheet 106. Alternatively, air director 130 can be formed separately and then attached, connected, or otherwise coupled within first channel 108, such as with top sheet 106, using, for example, adhesives, snap lock, hook and loop, thermal weld, and other mechanical fasteners. Further, while air director 130 is depicted as being shaped as a cutoff sphere, other three-dimensional shapes can be used without departing from the spirit and scope of the present disclosure. In embodiments, a screen made with a meltable material, such as polyester, can be provided over aperture 120 such that, in the event of a fire, the screen would melt and close, at least in part, aperture 120.

Figure 3:
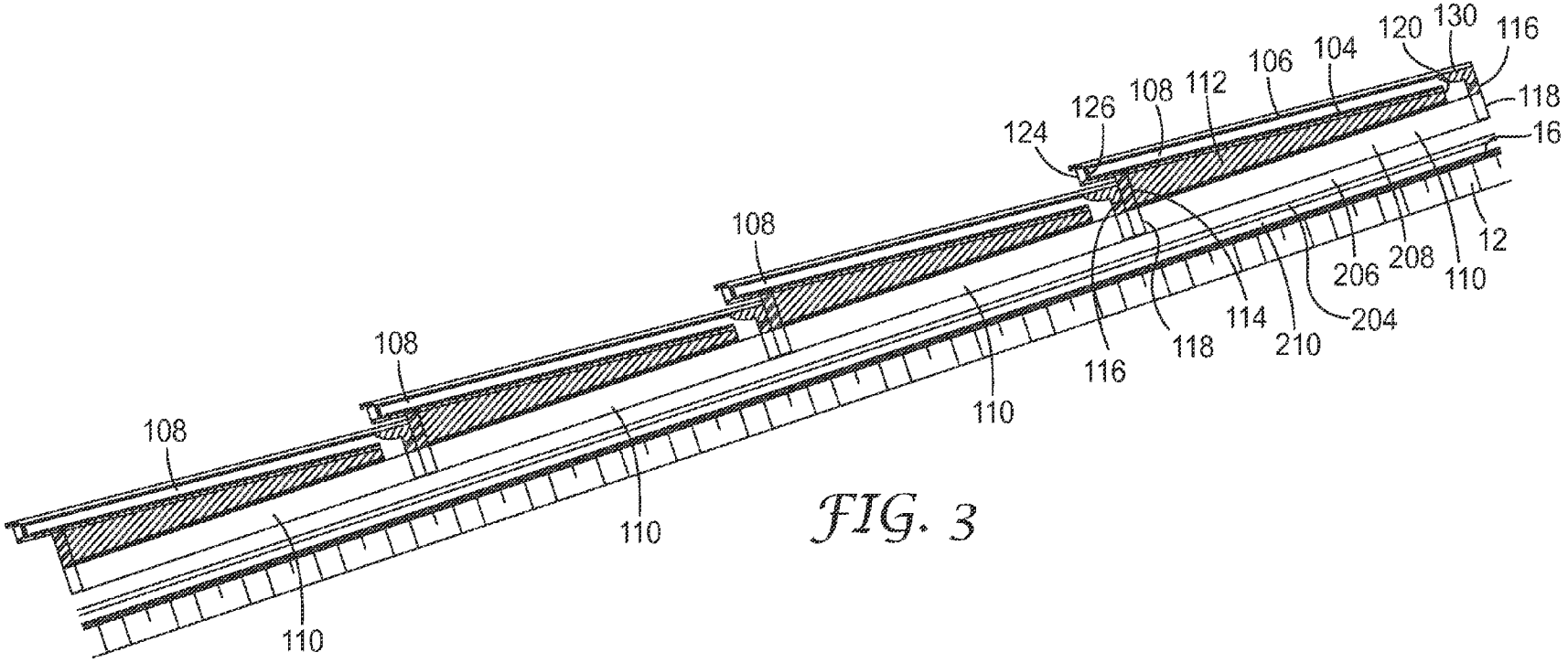
FIG. 3 is a fragmentary cross-sectional schematic side view of a sloped roof having a roofing system of FIG. 2 with four roofing articles of FIG. 1 thereon.

Referring to FIGS. 2 and 3, second channel 110 can be formed when roofing article 100 is connected to one or more rails 202 operably attached to a roof. Rails 202 can include a rail base 204 and a rail post 206 extending from rail base 204 and a rail head 208 operably coupled to rail post 206. Rails 202 can be formed integrally with or operably coupled to a rail sheet 210. Rail sheet 210 can be, for example, formed of dimension so as to facilitate assembly to a roof deck, such as in sheets that are four feet by eight feet in size. Rail sheets 210 can include one or more rails 202 operably coupled thereto, such as formed integrally therewith. Rail sheets 210 can comprise one or more radiant barrier film layers 146 or low emissivity surfaces. Radiant barrier film layers can be formed of a thin layer of a highly reflective material, such as aluminum, a silver metalized weatherable acrylic film (for example, film commercially available as 3M™ Solar Mirror Film 1100), or of a black body. In embodiments, the emittance of radiant barrier film layers is less than about 0.1 as measured by ASTM C1371. Rails 202 and rail sheets 210 can be formed of various high temperature and fire retardant materials, such as thermoplastic polymers, such as thermoplastic polyolefin, or fluoro or chloro polymers, such as polyvinylidene fluoride, fluorinated ethylene propylene, polytetrafluoroethylene, and polyvinyl chloride using various forming methods, such as, for example, extrusion, injection molding, or thermoforming, although other materials, such as polycarbonate, acrylonitrile butadiene styrene, aluminum, steel (for example, galvanized), and treated wood-based products, can be used to form each these components. Other forming methods can include, for example, metal stamping, press forming, pan forming, and various component and piece assembly methods.

Referring to FIG. 1, one or more radiant barrier film layers 146 or low emissivity surfaces can be included on roofing article 100 or, as described above, on rail sheet 210. Radiant barrier film layers can be formed of a thin layer of a highly reflective material, such as aluminum, a silver metalized weatherable acrylic film (for example, film commercially available as 3M™ Solar Mirror Film 1100), or of a black body. In embodiments, the emittance of radiant barrier film layers is less than about 0.1 as measured by ASTM C1371. As depicted, first channel 108 includes a radiant barrier film layer 146 on an underside of top sheet 106 and another on an upper side of bottom sheet 104. Second channel 110 includes a radiant barrier film layer 146 on an underside of insulation layer 112 and another on an upper side of rail sheet 210.

While not depicted, roofing article can further include intumescent material portion in or proximate to first channel 108 or in or proximate to second channel 110. Such intumescent material portion can undergo a chemical change when exposed to heat or flames to expand into a heat-insulating form to function as an airflow interrupter. This enables containment of fire and toxic gases and inhibits flame penetration, heat transfer, and movement of toxic gases. As used throughout this disclosure, "intumescent material" refers to a substance that when applied to or incorporated within a combustible material, reduces or eliminates the tendency of the material to ignite when exposed to heat or flame, and, in general, when exposed to flame, the intumescent substance induces charring and liberates non-combustible gases to form a carbonific foam which protects the matrix, cuts off the oxygen supply, and prevents dripping. Such heat can be at or about 350 degrees Fahrenheit. Intumescent materials can comprise an acid source, a char former, and a blowing agent. Examples of intumescent material include 3M™ Fire Barrier Wrap Ultra GS and REOGARD 1000 from Chemtura (formerly from Great Lakes Chemical Corporation).

Additionally, a phase change material (PCM) can be included at one or more locations in roofing article 100, such as, for example, in insulation layer 112. Such PCMs can undergo a solid/solid phase transition with the associated absorption and release of large amounts of heat. Like the intumescent material portion, can undergo a change when exposed to heat or flames to expand into a heat-insulating form or shape. Examples of PCMs include those commercial available from PCM Products Limited.

FIG. 3 depicts four roofing articles 100 arranged and installed on a roof (on top of roof deck 12 and felt 16). In this configuration: first post member 114 of the right-most roofing article 100 is adjacent to and abuts second post member 116 of the roofing article 100 second from the right; first post member 114 of the roofing article 100 second from the right is adjacent to and abuts second post member 116 of the roofing article 100 third from the right; and first post member 114 of the roofing article 100 third from the right is adjacent to and abuts second post member 116 of the left most roofing article 100. This arrangement enables air to flow through the second channel 110 created by an underneath each of the roofing articles. As will be described in greater detail below, air can also enter the second channel 110 of each of the roofing articles 100 from the first channel 108 of each through each of their respective apertures 120.

Figure 7:
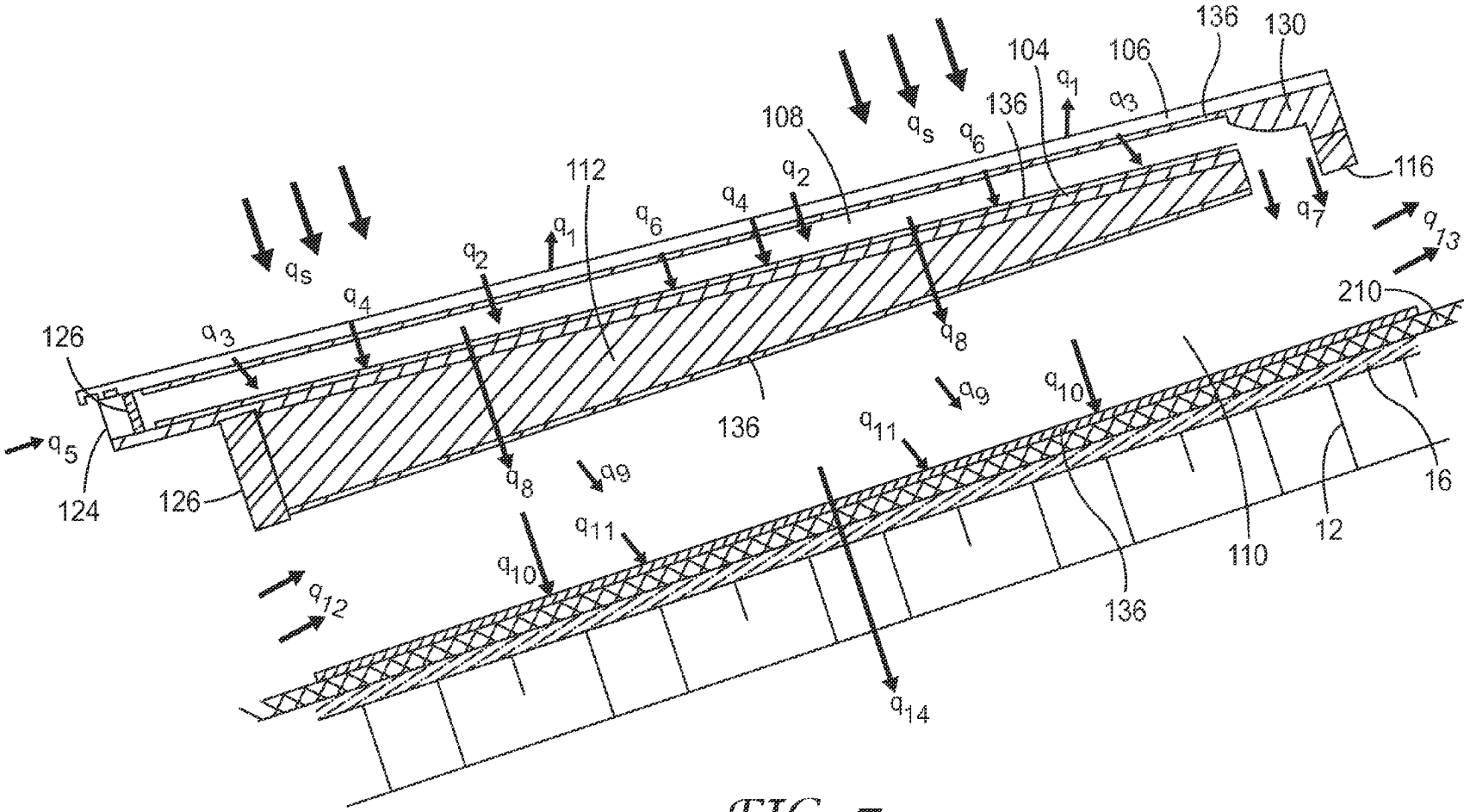
FIG. 7 is a cross-sectional schematic view of the roofing system of FIG. 2, further depicting the thermal energy transfer of the roofing article.

FIG. 7 depicts the thermal energy transfer of the roofing article 100 according to the various embodiments herein (first embodiment depicted). Each of the energy components, "q," are as follows:

| Item | Energy Component | Energy Description |
|---|---|---|
| 1 | $q_s$ | Solar and Spectrum Radiation |
| 2 | $q_1$ | Reflective Radiation and Convection |
| 3 | $q_2$ | Conduction Into First Channel |
| 4 | $q_3$ | Free Convection |
| 5 | $q_4$ | Net Radiation of First Channel |
| 6 | $q_5$ | Convection (Free and/or Force) |
| 7 | $q_6$ | Free Convection |
| 8 | $q_7$ | Convection (Free and/or Force) Through Aperture |
| 9 | $q_8$ | Conduction Into Second Channel |
| 10 | $q_9$ | Free Convection |
| 11 | $q_{10}$ | Net Radiation of Second Channel |
| 12 | $q_{11}$ | Free Convection |
| 13 | $q_{12}$ | Convection (Free and/or Force) |
| 14 | $q_{13}$ | Convection (Free and/or Force) |
| 15 | $q_{14}$ | Conduction Through Roof Deck Into Attic Space |

The energy balance equation is as follows:

$$q_s-q_1-q_2-q_4+q_5-q_6-q_7-q_8-q_9-q_{10}-q_{11}+q_{12}-q_{13}-q_{14}=0$$

Referring to FIG. 7, $q_s$ represents the solar energy from the sun. Of this energy, some of the energy ($q_2$) is transferred by conduction into first channel 108 and some of the energy ($q_1$) is transferred, by reflection and convection, back into the atmosphere. Additional energy may enter roofing article 100 through air inlet 124 ($q_5$) due to free and/or force convection. Of the energy that is in first channel 108, some may move due to free convection ($q_3$ and $q_6$), i.e., flow driven by the presence of a temperature gradient and/or density differences. The net radiation in first channel is transported as $q_4$. Of this, some is transferred by conduction into second channel 110 ($q_8$) and some by free and/or force through aperture 120. Additional energy may enter second channel 110 ($q_{12}$) due to free and/or force convection. Of the energy that is in second channel 110, some may move due to free convection ($q_9$ and $q_{11}$). The net radiation in second channel is transported as $q_{10}$. Of this, most is transferred by conduction out of second channel 110 ($q_{13}$) (to an adjacent roofing article or up and out of a ridge vent). The remainder ($q_{14}$) may be is transferred by conduction into an attic or unconditioned space.

Figure 4:
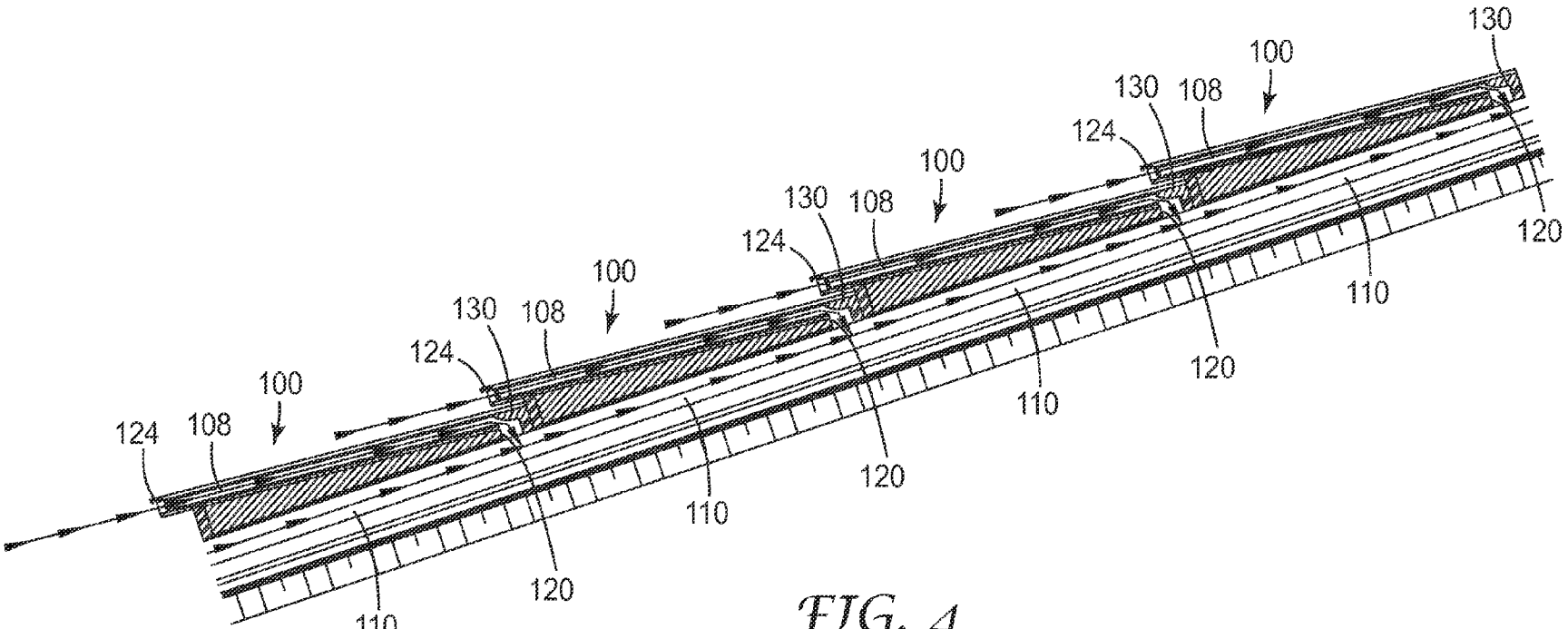
FIG. 4 is the fragmentary cross-sectional schematic side view of FIG. 3 depicting air flow.

FIG. 4 depicts air flow through a series of roofing articles 100. Air is depicted as entering the left-most roofing article 100 in two ways. First, outside air enters air inlet 124 and moves upwardly in first channel 108 towards aperture 120. When this air encounters air director 130, air director 130 directs or routes air downwardly through aperture 120 into second channel 110. Air can also enter left-most roofing article through second channel 110 (which can come from attic or unconditioned space). This air mixes with the air that has been directed into second channel through aperture 120. This mixed air then travels upwardly along the series of roofing articles 100 in their respective second channels 110 until the final, uppermost roofing article 100. At this point, air exits out second channel 110 of the right-most roofing article (to an adjacent roofing article or up and out of a ridge vent). In each of the roofing articles, air that enters air inlet 124 and then routed downwardly through aperture 120 into second channel 110 is mixed with the air traveling travels upwardly along the series of roofing articles 100 in their respective second channels.

FIG. 6 depicts the airflow mechanism through roofing articles in another view (top plan cutaway schematic view). Outside air (depicted in broken lines) enters roofing article 100 though air inlet 124. This air either travels between or around rib 128 towards aperture 120. Airflow director (not depicted) directs or routes air downwardly through aperture 120 into second channel. This outside air can mix with the air flow of second channel 110 (now depicted in thick solid lines). The mixed airflow travels though second channel 110. Eventually, additional air is directed into second channel 110 through apertures on subsequent, adjacent roofing articles and is mixed with this air to create channel mixed air.

FIG. 5 also depicts air flow through a series of roofing articles 100, but in an alternative fashion wherein some air backs out of an air inlet 124 of one of the roofing articles 100 (second roofing article 100 from right). As above, air is depicted as entering the left-most roofing article 100 in two ways. First, outside air enters air inlet 124 and moves upwardly in first channel 108 towards aperture 120. When this air encounters air director 130, air director 130 directs or routes air downwardly through aperture 120 into second channel 110. Air can also enter left-most roofing article through second channel 110. This air mixes with the air that has been directed into second channel through aperture 120. This mixed air then travels upwardly along the series of roofing articles 100 in their respective second channels 110. When the resistance to this mixed air continuing through the second channel 110 path becomes greater than of natural buoyancy, the mixed air flow will find the path to less resistance and begin flowing back out of aperture 120 between the second channel 110 and first channel 108 (i.e., the resistance against the incoming outside air in first channel 108 is less than that of continuing up second channel 110 path), the air will take the path of least resistance and back out of that first channel 108 and air inlet 124. As depicted in FIG. 5, this occurs on the third roofing article 100 from the left (or second roofing article 100 from the right). Factors that can affect whether the mixed air will continue to travel in the second channel path or back out of the air inlet include the size of the orifices, wind, barometric pressure, and the resistance of the fluid (air) inside second channel 110. For example, if the cross sectional area is increased and the bend/turns are minimized, the air flow will have or meet less resistance as the fluid travels up second channel 110.

As described above, depending on the climate, the roofing articles 100 can be designed so as to ensure or optimize that mixed air stays in the second channel 110 path. This can be done by minimizing the size of aperture 120 between the first channel 108 and second channel 110 so as to increase the resistance through the aperture 120 relative to the resistance of the second channel 110 pathway. Some climates where it can be desirable to ensure or optimize that mixed air stays in the second channel 110 path include colder climates. By retaining the mixed, warmer air in the second channel 110 path, it can help to heat the entire roof and, as a result, melt the snow on the entire roof.

Also, the roofing articles can be designed so as to allow for air to back out of an air inlet 124 included on one or more of the roofing articles 100. This can be done by maximizing the size of one or more apertures 120 between first channel 108 and second channel 110 so as to decrease the resistance through aperture 120 relative to the resistance of the second channel 110 pathway. Some climates where it can be desirable to release air from the second channel path include warmer climates. By enabling air to be released, it can help to keep the roof cooler.

Installation of the roofing articles on a roof can be as follows for the various embodiments of the present disclosure. While described with respect to the first embodiment, the installation method can be used for any of the various embodiments described herein.

Making reference to FIGS. 1-7, after the felt 16 or another covering material is installed on roof deck 12, a plurality of rail sheets 210 can be fastened or otherwise coupled to roof deck. For example, rail sheets 210 can be fastened to roof deck 12 using any of a number of mechanical fasteners, including nails or screws. For a left-handed roofing portion (i.e., sloping from left upwards to right), working from left to right for installation of roofing article 100, once rails sheets 210 have been fastened to roof deck 12 so as to create a plurality of rails 202, which can extend substantially continuously from a lower left edge of roof deck 12 to an upper edge of roof deck 12, such as at a ridge, a first roofing article 100 can be positioned on the lower left edge of roof deck 12 and, thus, rails 202. In embodiments, rails 202 can be operably coupled to a prepared deck from lower to upper edge of roof deck. Such a prepared deck can include radiant layer 146 operably coupled to roofing felt 16. Rails 202 can be operably coupled to the deck over radiant layer 146. An installation jig or the like can be used to ensure proper rail spacing.

Roofing articles 100 can be coupled to rails 202 by sliding bushing or rail huggers 118 along rail heads 208 until roofing article 100 operably abut a serially adjacent roofing article 100. Rails 202 can include one or more cutouts (not depicted) along a length thereof, such as in rail heads 208, so that roofing articles 100 can be coupled to rails 202 at intermediate positions thereof so that the assembly does not all have to start at an upper end of roof deck 12 (such as at the ridge end of the rails 202). This step can be repeated for other roofing articles 100 such that, for each roofing article 100, first post member 114 can operably abut second post member 116 of a serially adjacent roofing article 100 (see, for example, FIGS. 3-5). In embodiments, rail huggers 118 can comprise some flexibility and can snap or otherwise be attached directly to rails 202 and, in embodiments, rail huggers can be formed on the bottom side of article 100. A ridge vent cap can be placed over the ridge-side roofing article 100.

While the specification has described in detail certain exemplary embodiments, it will be appreciated that those skilled in the art, upon attaining an understanding of the foregoing, may readily conceive of alterations to, variations of, and equivalents to these embodiments. For example, international patent application number PCT/US2011/050664, filed Sep. 7, 2011, entitled "ABOVE-DECK ROOF VENTING ARTICLE," is incorporated by reference herein in its entirety, including, for example, the description of the various embodiments of the roofing article therein, which embodiments can be used in the roofing system according to the present disclosure. Additionally, U.S. Provisional Patent Application No. 61/494,266, filed Jun. 7, 2011, entitled, "SYSTEM AND METHOD FOR MANAGEMENT OF A ROOF" is incorporated by reference herein in its entirety, including, for example, the description of a roofing system, components, and method for managing airflow by or within the roofing system, the environmental thermal loads of the roofing system, the temperature of conditioned and/or unconditioned spaces in a building, and the ventilation of the conditioned and/or unconditioned spaces in a building. Also, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'. Various exemplary embodiments have been described. These and other embodiments are within the scope of the following claims.

What is claimed is:

1. A roofing article for installation on a roof deck, said roofing article comprising:

a body comprising an upper portion and an underside;

a first channel defined within said upper portion, said first channel comprising an inlet through which outside air can enter said first channel;

a second channel defined intermediate said underside of said body and the roof deck, wherein said second channel is operably connected to said first channel through an orifice such that the outside air can enter said second channel through said orifice; and an airflow interrupter for at least partially closing at least one of said first channel or said second channel when said airflow interrupter is exposed to temperatures at or greater than about 350 degrees Fahrenheit.

2. The roofing article of claim 1, wherein said second channel is in airflow communication with an unconditioned space and wherein unconditioned air from the unconditioned space can enter said second channel.

3. The roofing article of claim 2, wherein the unconditioned air entering said second channel can mix with outside air entering said second channel through said orifice to form mixed air.

4. The roofing article of claim 2, wherein the unconditioned space is an attic.

5. The roofing article of claim 1, further comprising insulation presented intermediate said first channel and said second channel.

6. The roofing article of claim 1, wherein said first channel comprises an first channel upper internal surface and a first channel lower internal surface, wherein one or more of said first channel upper internal surface and said first channel lower internal surface comprises a radiant barrier presented therewith.

7. The roofing article of claim 1, wherein said second channel comprises an second channel upper internal surface and a second channel lower internal surface, wherein one or more of said second channel upper internal surface and said second channel lower internal surface comprises a radiant barrier presented therewith.

8. The roofing article of claim 1, further comprising an air director presented in said first channel proximate said orifice to direct outside air into orifice.

9. The roofing article of claim 1, wherein said airflow interrupter comprises an intumescent material.

10. The roofing article of any claim 1, wherein a ratio of a cross section of said inlet to a cross section of said orifice is between about 2 to about 48.

11. The roofing article of claim 1, wherein a ratio of a cross section of said inlet to a cross section of said orifice is between about 1 to about 12.

12. The roofing article of claim 1, wherein said roofing article is operably coupled to one or more rails presented on a roof deck.

13. A roofing system comprising at least two roofing articles, each roofing article comprising:

a body comprising an upper portion and an underside;

a first channel defined in said body, said first channel comprising an inlet through which outside air can enter said first channel;

a second channel defined intermediate said underside of said body and the roof deck, wherein said second channel is operably connected to said first channel through an orifice such that the outside air can enter said second channel through said orifice, wherein the second channels of each of the at least two roofing articles are in airflow communication so as to create an airflow path between the at least two roofing articles; and an airflow interrupter presented with said airflow path for at least partially closing at least one of said first channel or said second channel when said airflow interrupter is exposed to temperatures at or greater than about 350 degrees Fahrenheit.

14. The roofing system of claim 13, wherein the second channel of each of the at least two roofing articles is in airflow communication with an unconditioned space and wherein unconditioned air from the unconditioned space can enter said second channel.

15. The roofing system of claim 13, wherein the unconditioned air entering said second channel of each of the at least two roofing articles can mix with outside air entering said second channel of the at least two roofing articles through said orifice to form mixed air, wherein said mixed air can exit said second channel of the at least two roofing articles.

16. The roofing article of claim 13, wherein said airflow interrupter comprises an intumescent material.

17. A roofing system for installation on a roof deck comprising:

at least two roofing articles, each roofing article comprising:

a body comprising an upper portion and an underside;

a first channel defined in said body, said first channel comprising an inlet through which outside air can enter said first channel;

a second channel defined intermediate said underside of said body and the roof deck, wherein said second channel is operably connected to said first channel through an orifice such that the outside air can enter said second channel through said orifice; and at least one rail presented on roof deck, wherein said at least two roofing articles are configured to be operably serially coupled to rail, such that said second channel of said at least two roofing articles is substantially aligned to create an airflow path; and an airflow interrupter presented with said airflow path for at least partially closing at least one of said first channel or said second channel when said airflow interrupter is exposed to temperatures at or greater than about 350 degrees Fahrenheit.

18. The roofing system of claim 17, wherein said rail is integrally formed with a rail sheet that can be operably coupled to the roof deck.

* * * * *

UNITED STATES PATENT AND TRADEMARK OFFICE

CERTIFICATE OF CORRECTION

PATENT NO. : 9,228,356 B2
APPLICATION NO. : 14/366291
DATED : January 5, 2016
INVENTOR(S) : John Edwards It is certified that error appears in the above-identified patent and that said Letters Patent is hereby corrected as shown below:

Specification

Column 9

Line 20, Delete "$-q_2-q_4+$" and insert -- $-q_2-q_3-q_4+$ --, therefor.

Signed and Sealed this
Twenty-eighth Day of June, 2016

Michelle K. Lee

Michelle K. Lee
*Director of the United States Patent and Trademark Office*